US007839342B2

(12) United States Patent
Su et al.

(10) Patent No.: US 7,839,342 B2
(45) Date of Patent: Nov. 23, 2010

(54) MULTI-FREQUENCY INVERTED-F ANTENNA

(75) Inventors: Wen-Fong Su, Tu-cheng (TW); Chen-Ta Hung, Tu-cheng (TW); Lung-Sheng Tai, Tu-cheng (TW); Yun-Lung Ke, Tu-cheng (TW); Po-Kang Ku, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 202 days.

(21) Appl. No.: 12/220,491

(22) Filed: Jul. 24, 2008

(65) Prior Publication Data

US 2009/0027277 A1 Jan. 29, 2009

(30) Foreign Application Priority Data

Jul. 24, 2007 (TW) ..... 96126866 A

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 6,861,986 | B2 | 3/2005 | Fang | |
| 6,963,310 | B2 * | 11/2005 | Horita et al. | 343/702 |
| 7,289,071 | B2 * | 10/2007 | Hung et al. | 343/702 |
| 7,298,334 | B2 * | 11/2007 | Fang et al. | 343/700 MS |
| 7,333,067 | B2 * | 2/2008 | Hung et al. | 343/770 |
| 7,642,967 | B2 * | 1/2010 | Wang et al. | 343/702 |
| 2005/0190108 | A1 | 9/2005 | Lin | |
| 2006/0250309 | A1 | 11/2006 | Fang | |

FOREIGN PATENT DOCUMENTS

| | | |
|---|---|---|
| TW | 563274 | 11/2003 |

* cited by examiner

*Primary Examiner*—Hoang V Nguyen
(74) *Attorney, Agent, or Firm*—Wei Te Chung; Andrew C. Cheng; Ming Chieh Chang

(57) ABSTRACT

A multi-frequency antenna A multi-frequency antenna comprising: a radiating patch having a first radiating element and a second radiating element; a grounding patch spaced apart from the radiating patch; a connecting element comprising a first connecting arm and a second connecting arm; a feeding line comprising an inner conductor and an outer conductor; wherein the first connecting arm connecting to the radiating patch and the second connecting arm connecting to the grounding patch; the first connecting arm locating in a first plane is perpendicular to the second connecting arm locating in a second plane.

19 Claims, 7 Drawing Sheets

MULTI-FREQUENCY INVERTED-F ANTENNA

BACKGROUND OF THE INVENTION

1. Field of the Invention

This invention relates to an antenna, more particularly to a multi-frequency inverted-F antenna for a portable electronic device.

2. Description of Prior Art

Wireless communication devices, such as cellular phones, notebook computers, electronic appliances, and the like, are normally equipped with an antenna that serves as a medium for transmission and reception of electromagnetic signals, such as date, audio, image, and so on. However, more and more portable electrical devices tend to miniaturization. Accordingly, antenna used in the portable electrical device need to tend to miniaturization.

Taiwanese patent No. 563274 discloses a multi-frequency inverted-F antenna that comprises: a conductive radiating element extending in a longitudinal direction and having opposite first and second ends lying in the longitudinal direction; a conductive grounding element spaced apart from the radiating element in a transverse direction relative to the longitudinal direction; a conductive interconnecting element extending between the radiating and grounding elements and including first, second, and third parts, the first part being electrically connected to the radiating element at a feeding point between the first and second ends of the radiating element, the second part being offset from the first part in the longitudinal direction and being electrically connected to the grounding element, the third part electrically interconnecting the first and second parts; and a feeding line electrically connected to the interconnecting element.

However, the multi-frequency antenna has relatively big size in height direction. Accordingly, many notebooks or other portable electronic devices do not have enough space to install such PIFA antenna.

SUMMARY OF THE INVENTION

An object of the present invention is to provide a multi-frequency antenna which has lower structure.

To achieve the aforementioned object, the present invention provides a multi-frequency antenna comprising: a radiating patch having a first radiating element and a second radiating element; a grounding patch spaced apart from the radiating patch; a connecting element comprising a first connecting arm and a second connecting arm; a feeding line comprising an inner conductor and an outer conductor; wherein the first connecting arm connecting to the radiating patch and the second connecting arm connecting to the grounding patch; the first connecting arm locating in a first plane is perpendicular to the second connecting arm locating in a second plane.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
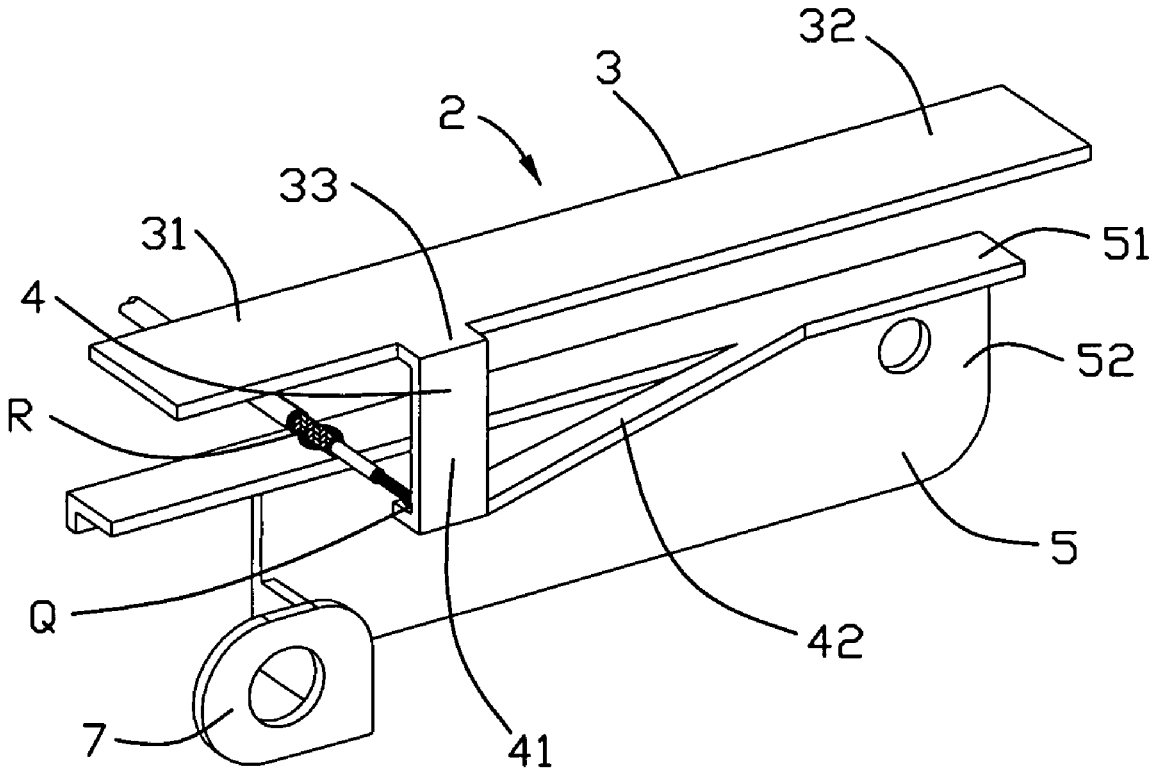
FIG. 1 is a perspective view of a multi-frequency antenna in accordance with a first embodiment of the present invention.
Figure 2:
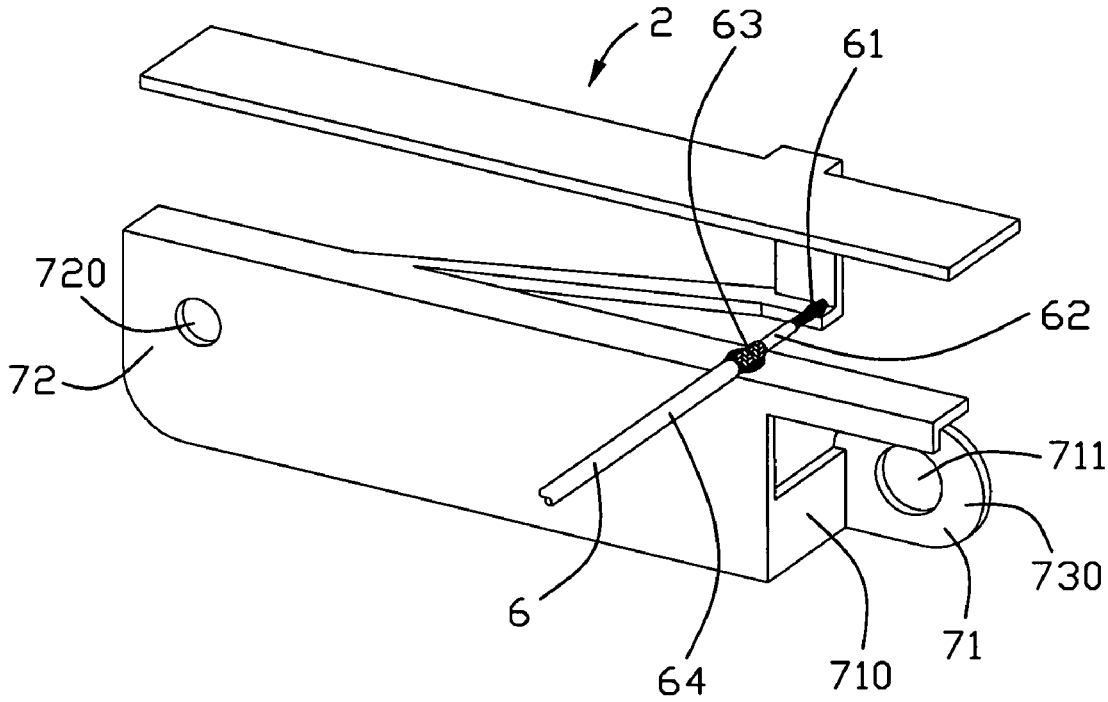
FIG. 2 is a view similar to FIG. 1, but from a different aspect.

Referring to FIGS. 1 and 2, a multi-frequency antenna 2 in accordance with a first embodiment of the present invention operating in WLAN comprises a radiating patch 3 lying in a horizontal plane, a grounding patch 5 spaced apart from the radiating patch 3, a connecting element 4 connecting the radiating patch 3 and the grounding patch 5, and a feeding line 6.

The radiating patch 3 extending in a longitudinal direction comprises opposite a first radiating element 31 and a second radiating element 32 lying in said longitudinal direction. The first radiating element 31 operates in 4.96-6.00 GHz frequency band. The second radiating element 32 operates in 2.2-2.80 GHz frequency band. The length of the first radiating element is shorter than the second radiating element.

The grounding patch 5 comprises a horizontal grounding element 51 and a vertical grounding element 52 perpendicular to the horizontal grounding element 51. The horizontal grounding element 51 has a top surface having a grounding point R. The vertical grounding element 52 has an installing structure 7. The installing element comprises a first auriform installing element 71 extending from a side of the vertical grounding 52 and a opposite second installing element 72. The first installing element 71 having L-shape comprises a first part 710 vertically extending from the vertical grounding element 52 and a second part 730 vertical to the first part 710. The second part 730 has a first installing hole 711. The second installing element 72 has a second installing hole 720.

The feeding line 6 comprises an inner conductor 61 electrically connecting to a feeding point Q, an inner insulating layer 62, an outer conductor 63 electrically connecting to the grounding point R, and an outer insulating layer 64.

The connecting element 4 having triangle-shape comprises a first connecting arm 41 perpendicular to the radiating patch 3 and a second connecting arm 42 paralleling to the radiating patch 3. The first connecting arm 41 connects to the radiating patch 3 at a joint point 33. The second connecting arm 42 extends from an edge of the horizontal grounding element 51. The horizontal grounding element 51 and the second connecting arm 42 form a certain angle and locate in a common horizontal plane. Accordingly, the connecting element 4 has grounding efficiency because of electrically connecting the radiating patch 3 and the grounding patch 5. The feeding line 6 electrically connects to the connecting element 4, accordingly, the connecting element 4 has signal feeding efficiency.

The multi-frequency antenna 2 has lower structure because the second connecting arm 42 of the connecting element 4 and the horizontal grounding element 51 locating in the common plane.

Figure 5:
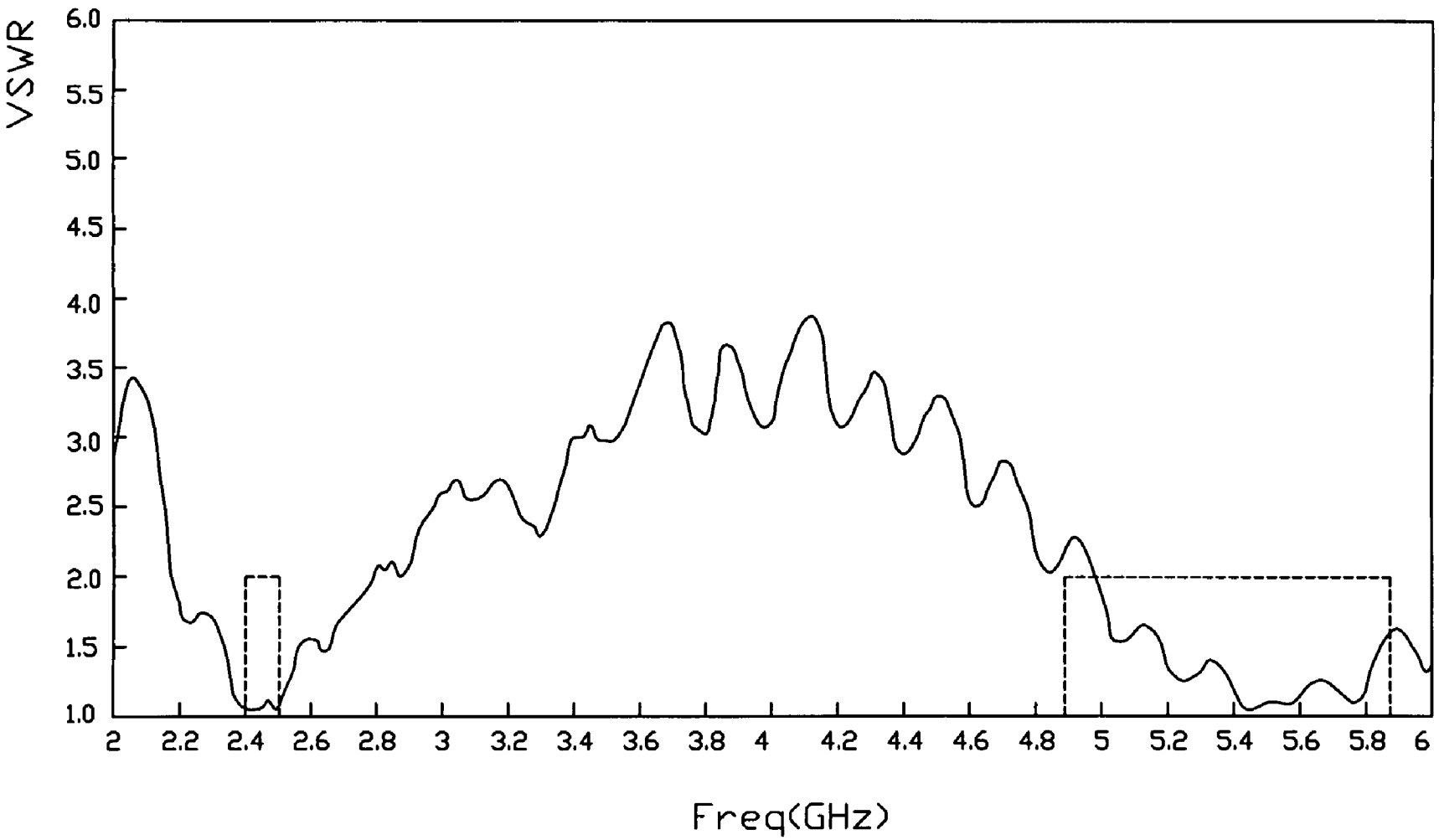
FIG. 5 is a test chart recording for the second antenna of the multi-frequency antenna in accordance with a first embodiment of the present invention, showing Voltage Standing Wave Ratio (VSWR) as a function of WLAN frequency.

FIG. 5 is a test chart of Voltage Standing Wave Ratio of the multi-frequency antenna 2. Referring to FIG. 5, operating frequency band of the multi-frequency antenna 2 are 2.412 GHz-2.4835 GHz and 5.15 GHz-5.85 GHz. Above-mentioned operating frequency band has covered all of the frequency bands of the WLAN, such as Bluetooth, Wi-Fi, and so on.

Figure 3:
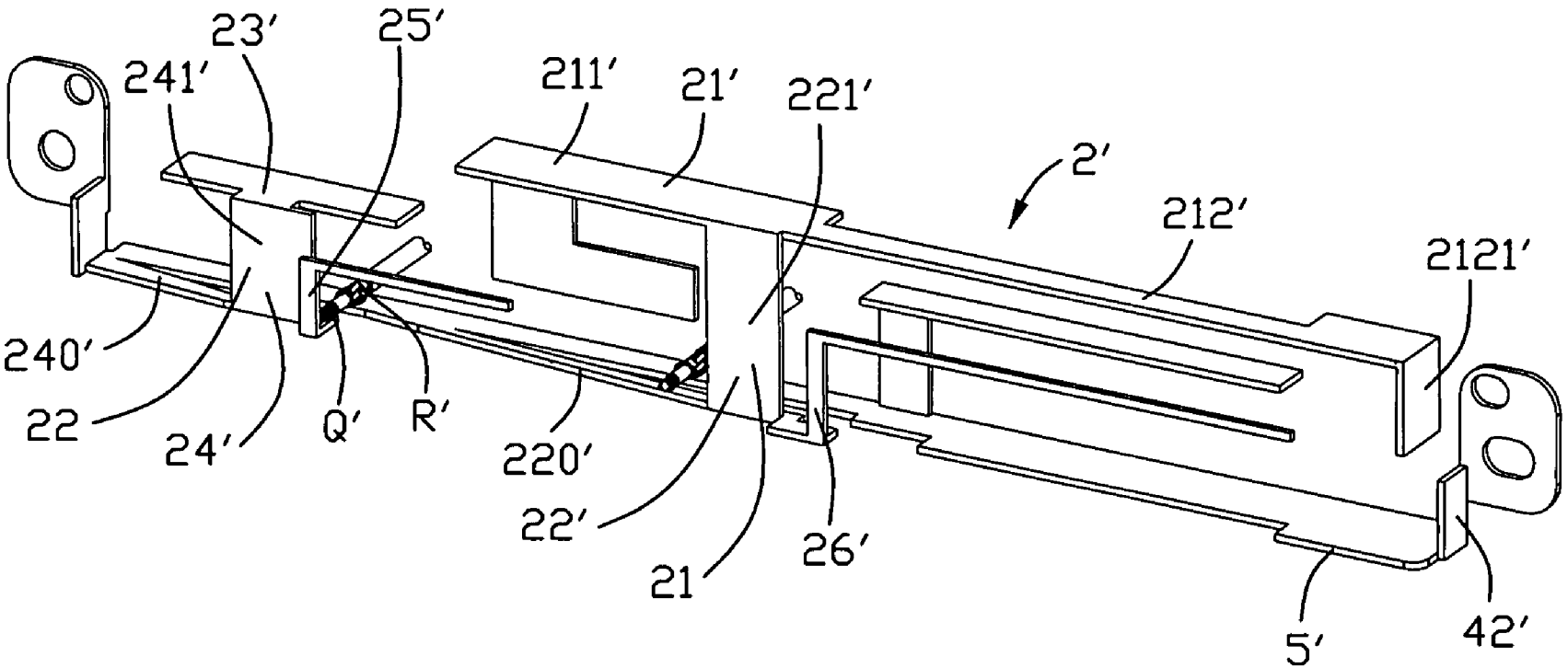
FIG. 3 is a perspective view of a multi-frequency antenna in accordance with a second embodiment of the present invention.
Figure 4:
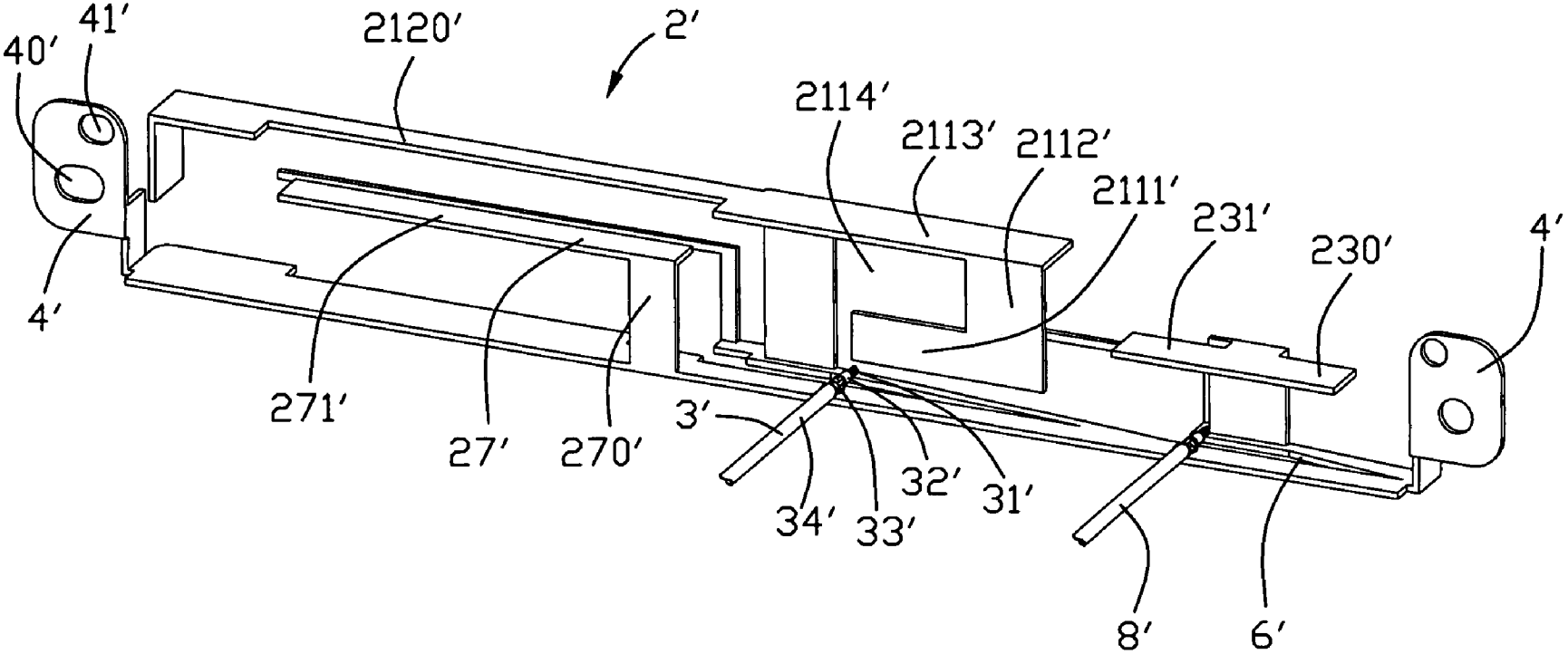
FIG. 4 is a view similar to FIG. 3, but from a different aspect.

Referring to FIG. 3 and FIG. 4, it's a multi-frequency antenna 2' in accordance with a second embodiment of the present invention. The multi-frequency antenna 2' comprises a first antenna operating in WWAN (Wide Wireless Area Network), a second antenna operating in UWB (Ultra Wide Band), and a grounding element 5'.

The grounding patch 5' extending in a longitudinal direction has two auriform installing element 4' at two ends of the grounding patch 5'. Each installing element 4' comprises a vertical part 42' and two installing hole 40', 41'.

The first antenna 21 comprises a first radiating element 21', a first connecting body 22' connecting the first radiating element 21' and the grounding element 5', a fourth radiating element 26', a coupling radiating element 27', and a feeding line 3'. The first radiating element 21' comprises a first radiating piece 211' and a second radiating piece 212'. The first radiating piece 211' comprises a first radiating arm 2113', a second radiating arm 2112' vertically and downwardly extending from the first radiating arm 2113', and a third radiating arm 2111' extending from the second radiating arm 2112' and paralleling to the first radiating arm 2113'. The first radiating arm 2113', the second radiating arm 2112', and the third radiating arm 2111' form a slot 2114'. The second radiating piece 212' extending in a longitudinal direction of the first radiating arm 2113' comprises a fourth horizontal radiating arm 2120' and a fifth radiating arm 2121' extending vertically from an end of the fourth arm 2120'. An inner side of the fourth radiating arm 2120' forms a cut. The first connecting body 22' having triangle-shape comprises a first horizontal connecting arm 220' paralleling to the first radiating element 21' and extending from an edge of the grounding element 5' and a second vertical connecting arm 221' paralleling to the first radiating element 21'. The fourth radiating element 26' having L-shape extends from a joint of the first horizontal connecting arm 220' and the second vertical connecting arm 221'. The coupling radiating element 27' having L-shape extends from another edge opposite to the first horizontal connecting arm 220'. The coupling radiating element 27' comprises a vertical coupling radiating element 270' and a horizontal coupling radiating element 271'. The cut is capable to reduce the interference between the coupling radiating element 27' and the second radiating piece 212'.

The feeding line 3' comprises an inner conductor 31' electrical connecting to the feeding point Q', an insulating layer 32', an outer conductor 33' electrical connecting to the grounding point R', and an outer insulating layer 34'.

The second antenna 22 comprises a second radiating element 23', a second connecting element 24', a third radiating element 25', and feeding line 8'. The second radiating element 23' comprises a third radiating piece 230' and a fourth radiating piece 231' being little longer than the third radiating piece 230'. The second connecting element 24' comprises a second vertical arm 241' and a second horizontal arm 240'. The second horizontal arm 240' extends from the bottom of the vertical part 42'. The second horizontal arm 240' and the grounding element 5' form a gap 6'. The second vertical arm 241' connects the second horizontal arm 240' and the second radiating element 23'. The third radiating element 25' similar to the fourth radiating element 26' extends from a joint of the second horizontal arm 240' and the second vertical arm 241'. The first connecting element 22' and the second element 24' extend from a same edge of the grounding element 5'. The feeding line 8' is same as the feeding line 3' and comprises an inner conductor electrical connecting to a joint of the third radiating element 25' and the second connecting element 24' and an outer conductor electrical connecting to the grounding element 5'.

Figure 6:
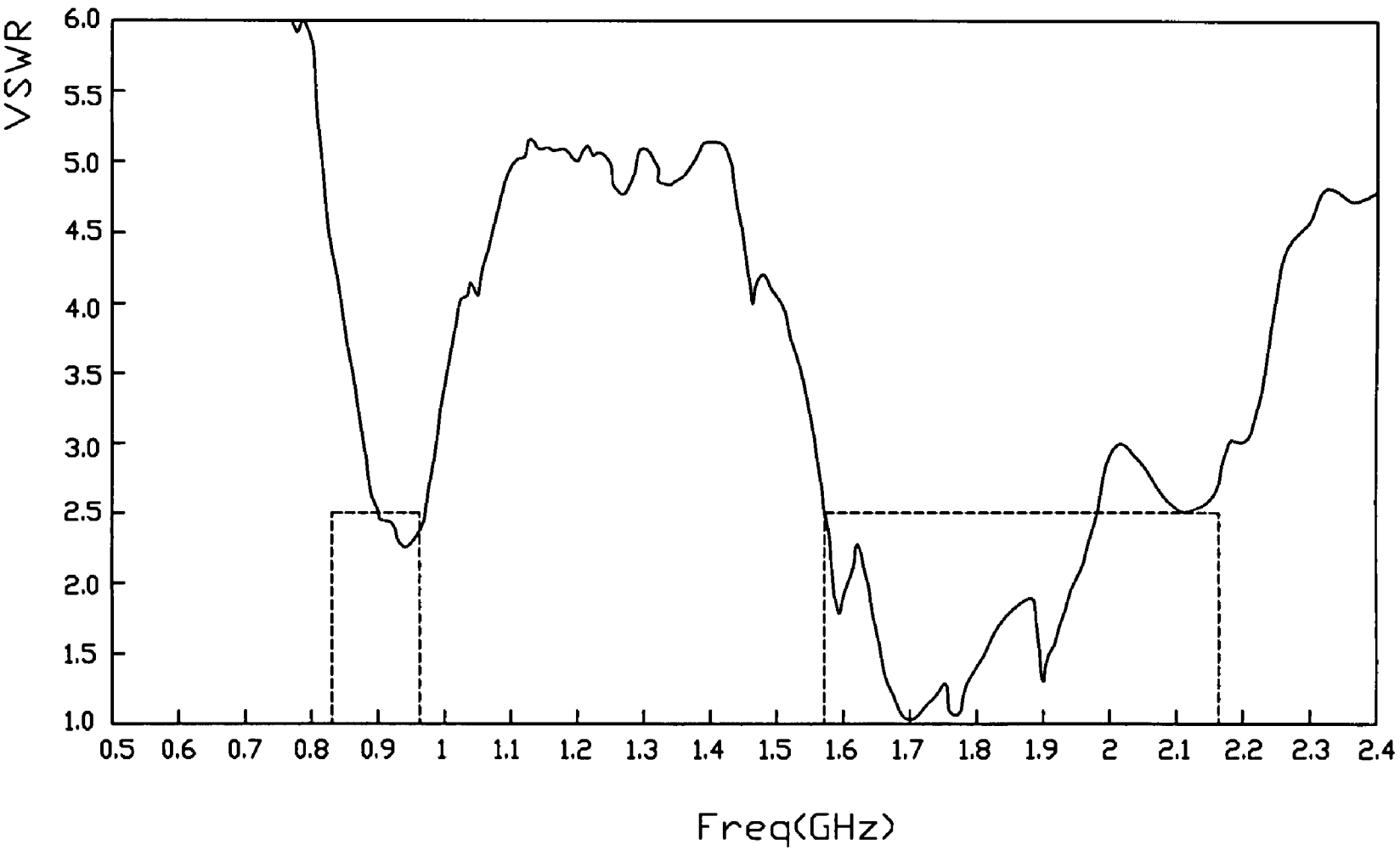
FIG. 6 is a test chart recording for the first antenna of the multi-frequency antenna in accordance with a second embodiment of the present invention, showing Voltage Standing Wave Ratio (VSWR) as a function of WWAN frequency.
Figure 7:
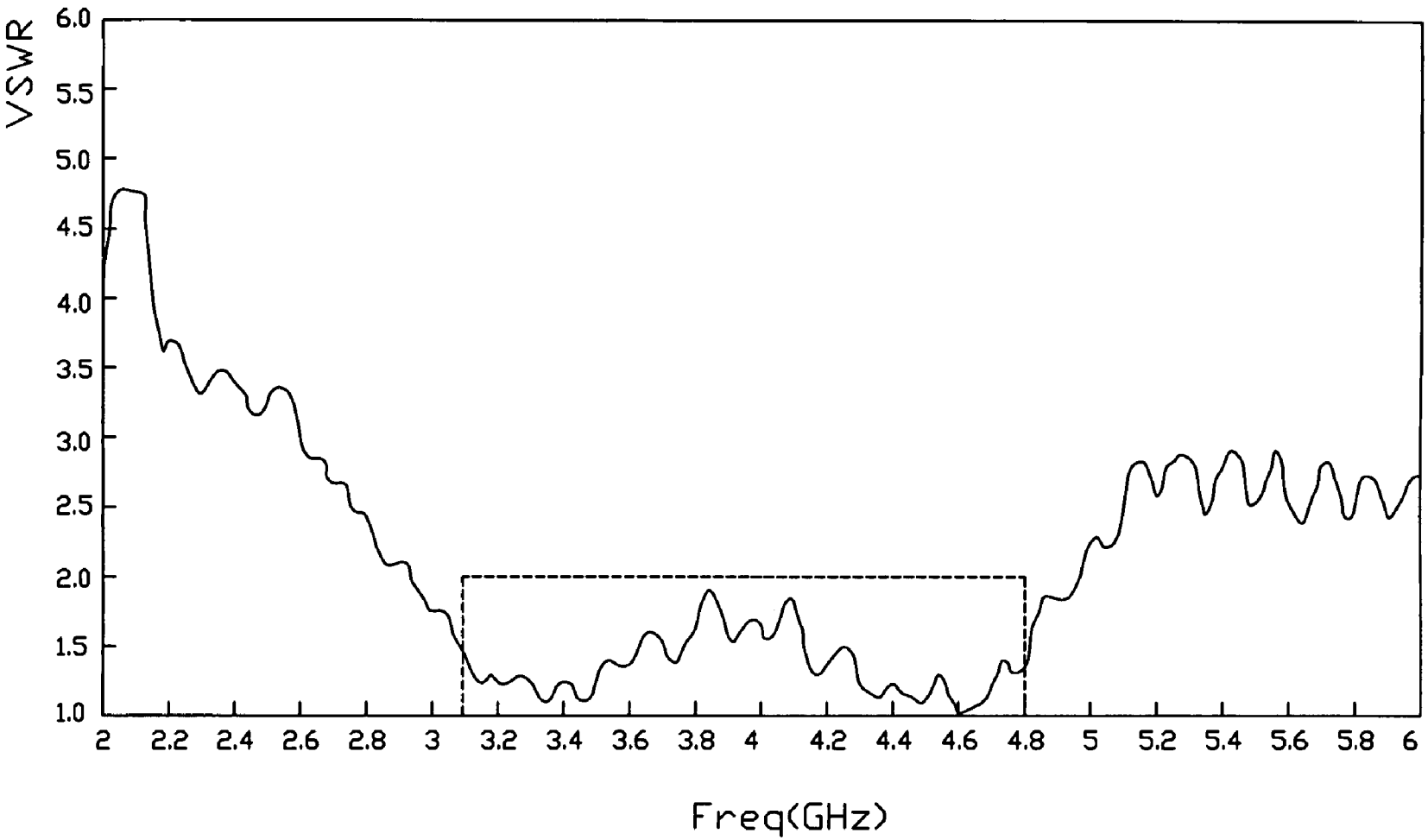
FIG. 7 is a test chart recording for the second antenna of the multi-frequency antenna in accordance with a second embodiment of the present invention, showing Voltage Standing Wave Ratio (VSWR) as a function of UWB frequency.

FIG. 6 and FIG. 7 are test chart of Voltage Standing Wave Ratio of the multi-frequency antenna 2' of second embodiment. Referring to FIG. 6, operating frequency band of the first radiating piece 211' of the first radiating element 21' is 1.58 GHz-2.12 GHz. Operating frequency band of the second radiating piece 212' of the first radiating element 21' is 0.90 GHz-0.96 GHz. Above-mentioned operating frequency band has covered the frequency bands of the WWAN. Referring to FIG. 7, operating frequency band of the second radiating element 23' and the third radiating element 25' is 2.94 GHz-4.95 GHz. Above-mentioned operating frequency band has covered the frequency bands of the UWB. The fourth radiating element 26' and coupling radiating element 27' can widen frequency band of the first radiating piece 211' of the first radiating element 21'.

Each of the first connecting element 22' and the second connecting element 24' has two arms and one arm locates a common plane with the grounding element. Accordingly, the multi-frequency antenna 2' has lower structure.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-frequency antenna comprising:

a radiating patch having a first radiating element and a second radiating element;

a grounding patch spaced apart from the radiating patch;

a connecting element comprising a first connecting arm and a second connecting arm;

a feeding line comprising an inner conductor and an outer conductor; wherein the first connecting arm connects to the radiating patch and the second connecting arm connecting to the grounding patch; the first connecting arm locates in a first plane is perpendicular to the second connecting arm locating in a second plane; wherein the connecting element is a triangle-shape.

2. The multi-frequency antenna as claimed in claim 1, wherein said grounding patch and the second connecting arm locate in a common plane.

3. The multi-frequency antenna as claimed in claim 1, wherein said first connecting arm of the connecting element extends vertically and downwardly from an edge of the radiating patch.

4. The multi-frequency antenna as claimed in claim 1, wherein said grounding patch comprises a horizontal grounding element and a vertical grounding element.

5. The multi-frequency antenna as claimed in claim 4, wherein said second connecting arm of the connecting element extends from an edge of the horizontal grounding element.

6. The multi-frequency antenna as claimed in claim 5, wherein a gap is formed between the horizontal grounding element and the second connecting arm.

7. The multi-frequency antenna as claimed in claim 4, wherein said horizontal grounding element and the second connecting arm locate in a common plane.

8. The multi-frequency antenna as claimed in claim 4, wherein said radiating patch is parallel to the horizontal grounding element.

9. The multi-frequency antenna as claimed in claim 4, wherein said inner conductor electrically connecting to a joint of the first connecting arm and the second connecting arm and said outer conductor electrically connecting to the horizontal grounding element.

10. The multi-frequency antenna as claimed in claim 4, wherein said vertical grounding element has a installing element having a installing hole.

11. A multi-frequency antenna comprising:

a grounding element having a first and a second longitudinal sides;

a first antenna, operating in a first wireless network, comprising a first radiating body spaced apart from the grounding element and a first connecting element connecting the first radiating body and the grounding element;

a second antenna, operating in a second wireless network, comprising a second radiating body spaced apart from the grounding element and a second connecting element connecting the second radiating body and the grounding element; wherein the first connecting element comprises a first horizontal connecting arm and a first vertical connecting arm, the first horizontal connecting arm and the grounding element locates in a common plane and form a gap; the second connecting element comprises a second horizontal connecting arm and a second vertical connecting arm, the second horizontal connecting arm and the grounding element locates in a common plane and form a gap.

12. The multi-frequency antenna as claimed in claim 11, wherein said first vertical connecting arm extends vertically and downwardly from an edge of the first radiating body; said second vertical connecting arm extends vertically and downwardly from an edge of the second radiating body.

13. The multi-frequency antenna as claimed in claim 11, wherein said first antenna comprises a coupling radiating element having L-shape.

14. The multi-frequency antenna as claimed in claim 11, wherein said first radiating body and second radiating body are parallel to the grounding element.

15. A multi-frequency antenna comprising:

a radiating patch extending along a lengthwise direction and having opposite first and second radiating elements thereof;

a grounding element extending along said lengthwise direction, defining a plane thereof, and spaced from the radiating patch and;

a connecting element linked between the radiating patch and the grounding element under condition that a joint region between the radiating patch and the connecting element divides said first and second radiating elements; wherein said connecting element includes a first connecting arm, which is connected to the grounding element, and a second connecting arm, which is connected to the radiating patch, being angled with each other, one of which extends obliquely with regard to said lengthwise direction.

16. The multi-frequency antenna as claimed in claim 15, wherein said the first connecting arm is essentially coplanar with the grounding element.

17. The multi-frequency antenna as claimed in claim 16, wherein the radiating patch is parallel to the grounding element, and the second connecting arm is perpendicular to the first connecting arm.

18. The multi-frequency antenna as claimed in claim 17, further including another grounding element unitarily extending from and perpendicular to said grounding element on which at least one securing section is located for securing said antenna within an electronic device.

19. The multi-frequency antenna as claimed in claim 15, further including a third radiating element unitarily extending from the first connecting arm in a plane angled with regard to both the radiating patch and the first connecting arm.

* * * * *